US009404640B2

(12) United States Patent
Zhang et al.

(10) Patent No.: US 9,404,640 B2
(45) Date of Patent: Aug. 2, 2016

(54) HIGH EFFICIENT AND HIGH POWER LED LIGHT SOURCE, LED LAMP WHICH USES LIGHT SOURCE AND THE APPLICATION OF THE LAMP

(71) Applicant: SHANGHAI CATA SIGNAL CO.,LTD., Shanghai (CN)

(72) Inventors: Wenhu Zhang, Shanghai (CN); Qiuhua Zheng, Shanghai (CN)

(73) Assignee: SHANGHAI CATA SIGNAL CO., LTD., Shanghai (CN)

( * ) Notice: Subject to any disclaimer, the term of this patent is extended or adjusted under 35 U.S.C. 154(b) by 119 days.

(21) Appl. No.: 14/309,890

(22) Filed: Jun. 20, 2014

(65) Prior Publication Data

US 2014/0299897 A1 Oct. 9, 2014

Related U.S. Application Data

(63) Continuation-in-part of application No. 13/129,877, filed on May 18, 2011, now abandoned.

(51) Int. Cl.
*F21V 13/14* (2006.01)
*F21V 13/04* (2006.01)
(Continued)

(52) U.S. Cl.
CPC . *F21V 13/04* (2013.01); *F21K 9/50* (2013.01); *F21V 5/008* (2013.01); *F21V 7/0083* (2013.01);
(Continued)

(58) Field of Classification Search
CPC ..... F21S 48/215; F21S 48/2212; F21S 48/24; F21S 48/328; F21V 5/008; F21V 7/04; F21V 7/048; F21V 7/0083; F21V 13/04; F21V 5/04; F21V 5/045; F21V 7/0033; F21V 29/004; F21V 29/74; F21V 5/007; F21V 5/002; F21V 5/004; F21V 5/048; F21V 7/0016; F21V 7/0043; F21Y 2101/02; F21Y 2103/003; F21Y 2105/001
USPC ..... 362/217.01, 217.02, 217.04, 217.1, 362/217.12–217.17, 218, 219, 222, 223, 362/225, 227, 240, 244, 246, 249.01, 362/249.02, 249.11, 282, 285, 294, 309, 362/310, 326, 327, 335, 351, 362, 365, 370, 362/373–375, 395, 396, 410, 431, 432, 800
See application file for complete search history.

(56) References Cited

U.S. PATENT DOCUMENTS 4,733,335 A * 3/1988 Serizawa ..... B60Q 1/302 362/373
6,575,610 B2 * 6/2003 Natsume ..... F21S 48/2212 362/308

(Continued)

*Primary Examiner* — Hargobind S Sawhney
(74) *Attorney, Agent, or Firm* — Raymond Y. Chan; David and Raymond Patent Firm

(57) ABSTRACT

A light module includes a plurality of LEDs coupled on a circuit board, a condenser unit including a plurality of condensers integrally coupled with each other and supported on the circuit board, and a plurality of converging lenses supported within the light cavities of said condensers respectively. Each LED is located at a focal point of the condenser and is located at a focal point of the converging lens. A first portion of light from the LED is directly project toward the converging lens and is diverged by the converging lens to parallelly project out of the condenser. A second portion of light from the LED is reflected by a light reflecting wall of the condenser to parallelly project out of the condenser. Therefore, the first and second portions of light form collimated light beams out of a light opening of the condenser.

13 Claims, 5 Drawing Sheets

(51) Int. Cl.

| | |
|---|---|
| ***F21K 99/00*** | (2016.01) |
| ***F21V 7/00*** | (2006.01) |
| *F21S 6/00* | (2006.01) |
| *F21V 5/00* | (2015.01) |
| *F21V 5/04* | (2006.01) |
| *F21V 21/30* | (2006.01) |
| *F21Y 101/02* | (2006.01) |
| *F21Y 105/00* | (2016.01) |
| *F21V 29/74* | (2015.01) |

(52) U.S. Cl.
CPC *F21S 6/003* (2013.01); *F21V 5/007* (2013.01); *F21V 5/048* (2013.01); *F21V 21/30* (2013.01); *F21V 29/74* (2015.01); *F21Y 2101/02* (2013.01); *F21Y 2105/001* (2013.01)

(56) References Cited

U.S. PATENT DOCUMENTS

| | | | | |
|---|---|---|---|---|
| 6,914,724 | B2 * | 7/2005 | Redmond | G02B 3/00 216/24 |
| 7,008,079 | B2 * | 3/2006 | Smith | F21V 7/0083 362/235 |
| 7,158,298 | B2 * | 1/2007 | Miyata | G03B 21/10 359/453 |
| 7,246,917 | B2 * | 7/2007 | Rhoads | F21V 7/0025 362/241 |
| 7,281,820 | B2 * | 10/2007 | Bayat | F21L 4/02 362/245 |
| 7,543,941 | B2 * | 6/2009 | Holder | F21V 14/02 353/43 |
| 7,950,821 | B1 * | 5/2011 | Georgitsis | B60Q 1/0483 362/217.12 |

* cited by examiner

HIGH EFFICIENT AND HIGH POWER LED LIGHT SOURCE, LED LAMP WHICH USES LIGHT SOURCE AND THE APPLICATION OF THE LAMP

CROSS REFERENCE OF RELATED APPLICATION

This is a CIP application that claims the benefit of priority under 35U.S.C.§119 to a non-provisional application, application Ser. No. 13/129,877, filed May 18, 2011.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a LED lamp, and more particularly, to a high-power LED light source. It also relates to a high-power LED lamp which uses such light source, and the application of such lamp.

2. Description of Related Arts

Currently, people all over the world are seeking for solution of the conflict between economic development and energy shortage. As the light-emitting diode (LED) technology develops, its cost drops rapidly. As a result, the LED technology has been used more and more widely in fields of automobile lighting, traffic signal devices, and illumination. The development and application of LED lamps will inevitably bring a broad market prospect and new opportunities of economic development for the entire energy-efficient lighting and green lighting industry, while the high-power LED is an inevitable choice for lighting appliances.

In recent years, the optical model of the single Total Internal Reflected (TIR) resin converging lens 1, equipped with the corresponding high-power LED has been used in most designs and applications of such high-power LED lamps at home and abroad so as to collect optical energy and collimate light rays (see FIG. 1). TIR resin converging lens 1 consists mostly of one piece of substantial transparent resin and it is required that the entire piece of resin be highly glabrous on the surface with highly uniform internal density and high transmittance. Therefore, the production process of TIR resin converging lens 1 is complicated, and the cost is higher. Furthermore, the single TIR resin converging lens 1 can only be used to make LED light source products with small light spots, not large-scale surface light source LED lamps, and its application and lighting effect are thus limited.

In addition to the above problems, there are still other disadvantages: the luminous efficiency of lamps using this optical model is generally low, and there are bright spots on the emitting surface because of regional light concentration. A number of bright spots appear when LEDs are arranged sparsely, causing a negative effect on the overall fullness and softness of the light emitted by high-power LED lamps.

SUMMARY OF THE PRESENT INVENTION

The first technical problem to be solved by the present invention is to provide a high-power LED light source with a front converging lens to improve the luminous efficiency of the existing high-power LED light source, and to enhance the fullness and softness of the light.

The second technical problem to be solved by the present invention is to provide a lamp which uses the said LED light source.

The third technical problem to be solved by the present invention is to provide applications of the said lamp.

As the first aspect of the present invention, a high-power LED light source comprises an LED, and a condenser which concentrates the light emitted by the LED, wherein the said condenser is a concave mirror/lens, and the emitting part of the said LED is located at the focus of the said concave mirror; and a converging lens which is located in front of the said LED, wherein the focus of the said converging lens is at the emitting part of the said LED, or in the vicinity of the emitting part of the said LED according to the requirement of the optical design to meet the functional demands of different lamps. The location of the emitting part of the said LED at the focus of the said concave mirror facilitates the emitting of highly-efficient and collimated light beams and the formation of a surface light source.

The said converging lens is a lens with a condensing function, e.g. a convex lens, and the preferred embodiment is a Fresnel lens which fully concentrates the light scattered outside the condensing wrap angle in front of the concave mirror to maximize the overall condensing efficiency of the LED light source.

As the second aspect of the present invention, a lamp comprises a casing, wherein a certain number of closely-spaced high-power LED light sources are located in the said casing with each high-power LED light source comprising an LED and a condenser which concentrates the light emitted by the LED, and wherein the said condenser is a concave mirror and the emitting part of the said LED is located at the focus of the said concave mirror; a converging lens located in front of the said LED, wherein the focus of the said converging lens is located at the emitting part of the said LED or in the vicinity of the emitting part of the said LED according to the final optical design to meet the functional demands of different lamps. The location of the emitting part of the said LED at the focus of the said concave mirror facilitates the emitting of highly-efficient and collimated light beams and such closely spaced high-power LED light sources can produce suitable high-density collimated light beams, forming a surface light source thus facilitating the light distribution design of the lamp.

The said converging lens may be a lens with condensing function, such as a convex lens. The preferred embodiment of the converging lens is a Fresnel lens.

In the lamp of the present invention, the concave mirror and the converging lens of each high-power LED light source concentrate the light emitted by the LED in the same direction, i.e. the emitted light beams have the same emitting direction. The adoption of multiple LEDs can effectively improve the intensity of the light and adoption of the above-mentioned technical scheme can effectively improve the directivity of the light.

In the lamp of the present invention, the concave mirrors of each high-power LED light source are placed closely on the same plane and the light beams emitted by each LED are therefore arranged tightly, making the light emitted by the lamp full, well-distributed and without scattered glaring bright spots as a whole.

In the lamp of the present invention, the said high-power LED light sources can be arranged in either a honeycombed shape or a rectangular array.

In the lamp of the present invention, the concave mirrors of each high-power LED light source are interconnected.

The converging lens of each high-power LED light source can be located at a proper position in relation to the LED light source individually or located at a proper position in relation to the LED light sources as one integrated piece.

The lamp of the present invention also comprises a printed wiring board, where the LEDs of the high-power LED light source are set. A metal-based heat sink cooling plate is set on the said printed wiring board.

In the lamp of the present invention, the LED of the high-power LED light source can be a monochromatic single-chip high-power LED or a monochromatic multi-chip high-power LED, or a multi-chip color-changeable high-power LED.

In the lamp of the present invention, a transparent cover or a diffusing lens which can diffuse and distribute the light is set in front of the converging lenses of the said high-power LED light sources. The surface of the said diffusing lens is densely covered with diffusing particles. The said diffusing particles are lenses with light-diffusing function. The light beams emitted by each LED are diffused by the diffusing lens to a certain angle so as to meet the requirements of different functions of the lamps. When used together with an atomized soft-light lens or a soft-light lens added with light diffusing agent, the lamp can emit light which is even softer and fuller as a whole.

When a convex lens is adopted as the converging lens of the present invention, the manufacture of the convex lens is easy because optical parameters of the convex lens are easy to control, and costs of the mould are low. In addition, the convex lens is easy to clean for the smooth surface.

When a Fresnel lens is adopted as the converging lens of the present invention, the costs as well as the overall weight of the product can be reduced since less material is used.

A rear cover is set behind the said casing for eliminating the heat from the LED, and the said metal-based heat sink is compressed tightly to the said rear cover.

The third aspect of the present invention relates to the application, wherein the lighting appliance can be used for indoor lighting, automobile lighting, road lighting or advertising lighting or as searchlight.

Based on the above-mentioned design, the present invention is particularly suitable for high-power LED lamps where the power of a single LED is more than 0.5 W.

The original high-power LED lamp only adopts TIR lens as the condenser, especially the single Total Internal Reflection (TIR) resin converging lens. The TIR resin converging lens consists mostly of one piece of substantial transparent resin and the entire piece of resin must be highly polished on the surface with highly uniform internal density and high transmittance. Therefore, the production process of such TIR resin converging lens is complicated and the cost is high. Furthermore, the single TIR resin converging lens can only be used to fabricate a small-scale light source product, not a large-caliber LED light source product. Within a certain range of power, the number of LEDs is limited. As a result, light beams emitted by such light sources are relatively narrow. Therefore, the light emitted by the lamps with such light sources will have a large number of apparent bright spots when LEDs are sparsely spaced. Such tiny bright spots pose a negative effect on the overall fullness and softness of the light emitted by the high-power LED lamps, and thus affect the lighting effect and limit its application scope.

In the above-mentioned technical scheme of the present invention, a concave mirror and a converging lens are adopted instead of the original TIR lens, bringing the following technical effects:

Firstly, the production processes of the concave mirror and the converging lens are well developed. The concave mirror is a common condenser used for car lighting, flashlight, etc. Its cost is low, and the concave mirror with large caliber can easily be produced. The convex lens or the Fresnel lens which is used as the converging lens is also characterized by its low cost, and the large convex lens or the Fresnel lens with large area is also easily produced. By adopting the concave mirror with large caliber and the convex lens or the Fresnel lens with large area, the cross-sectional area of the light beams will increase significantly, and thus, when LEDs are sparsely spaced, there will not be many bright spots, making the light emitted from the high-power LED lamps fuller and softer, the overall lighting effect better and the application scope wider.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

In order to make the technical means, characteristics, purpose, and effect of the present invention easy to understand, a further description of the present invention is given as below with reference to the corresponding drawings.

Figure 2:
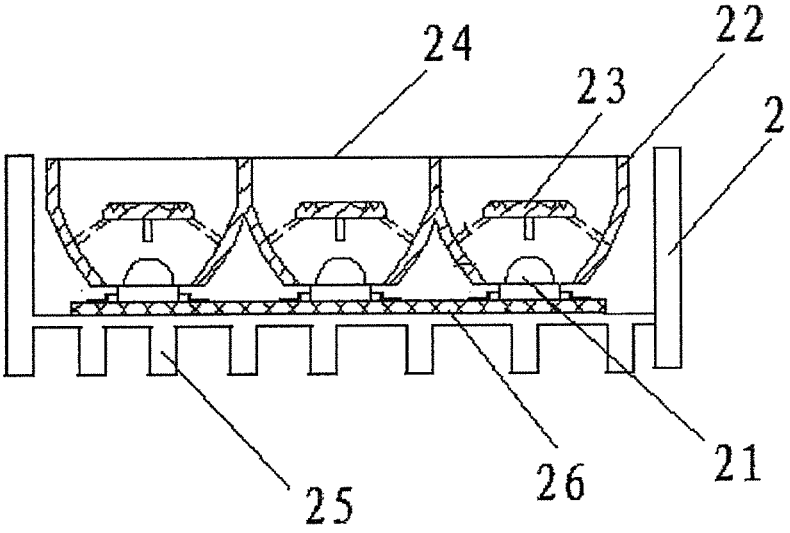
FIG. 2 is a cross-sectional view of a lamp and its high-power LED light source of the present invention.
Figure 3:
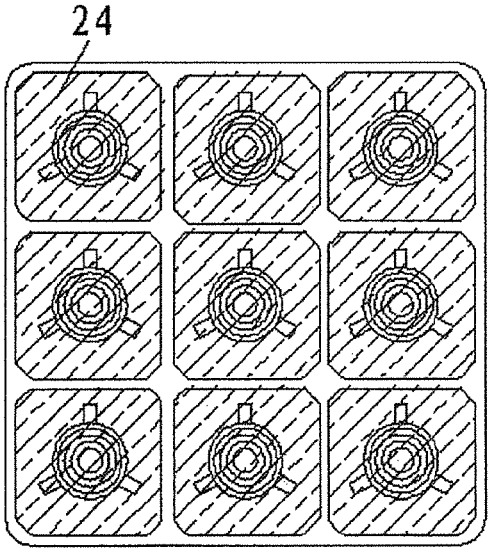
FIG. 3 is a front view of a lamp and its high-power LED light source of the present invention.

Referring to FIGS. 2 and 3, the lamp comprises a casing 2, wherein several high-power LED light sources are closely spaced inside the casing 2. These high-power LED light sources can be arranged either in a honeycombed shape or in a rectangular array (as shown in FIG. 2).

Each high-power LED light source comprises LED 21, and a concave mirror 22 which condenses the light is placed on top of the LED 21. The emitting part of the LED 21 is located at the focus of the concave mirror 22. The converging lens 23 is set in front of the LED 21, and the focus of the converging lens 23 is located at the emitting part of the LED 21. This design facilitates the emitting of collimated light beams and is suitable for occasions where collimated light beams are needed. The converging lens 23 can be either a convex lens or a Fresnel lens.

Figure 1:
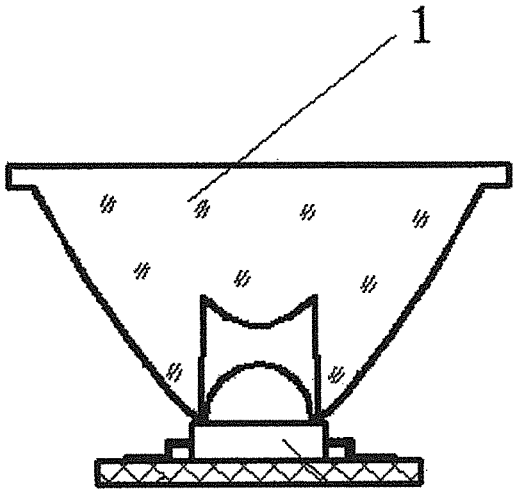
Fig. 1 Prior Art
FIG. 1 is a structure drawing of a prior art high-power LED lamp.

Referring to FIG. 1, most prior art high-power LED lamps only use a TIR lens as a condenser, especially single Total Internal Reflection (TIR) resin converging lens 1. The TIR resin converging lens 1 consists mostly of one piece of substantial transparent resin. It is required that the entire piece of resin shall be highly polished on the surface, with highly uniform internal density and high transmittance. Thus the production process of the TIR resin converging lens 1 is complicated, and the cost is high. Furthermore, such TIR resin converging lens 1 can only be used for fabricating small-scale light source products. It cannot be used for producing LED light source products with large caliber. Therefore, it can only emit narrow concentrated light beams. Within a certain range of power, the number of LEDs used is limited. When LEDs are arranged sparsely to keep the necessary shape and dimension of the lamp, the light emitted by the lamp will have a large number of apparent bright spots. Such tiny bright spots will cause a negative effect on the general fullness and softness of the light emitted by the high-power LED lamp, and limit the application range and affect the lighting effect.

Referring to FIG. 2, in the above-mentioned technical scheme of the present invention, a concave mirror 22 and a converging lens 23 are adopted instead of the original TIR resin converging lens 1, bringing the following technical effects:

Firstly, the production processes of concave mirror 22 and converging lens 23 are well developed. A concave mirror is a common condenser used for car lighting, flashlight, etc. Its cost is low, and the concave mirror 22 with large caliber can be easily produced. A convex lens or a Fresnel lens which is used as the converging lens 23 is also characterized by its low cost, and the convex lens or the Fresnel lens with large area can be easily produced. By adopting the concave mirror 22 with large caliber and the convex lens or Fresnel lens with large area, the cross-sectional area of light beams can be increased significantly, and thus, when LEDs are sparsely spaced, there will not be many bright spots, making the light emitted from the high-power LED lamps fuller and softer, the overall lighting effect better and the application scope wider.

When a convex lens is adopted as the converging lens 23 of the present invention, the convex lens will be easy to produce because the optical parameters of the convex lens are easy to control and the cost of the mould is low. In addition, the convex lens is easy to clean for the smooth surface. When a Fresnel lens is adopted as the converging lens 23 of the present invention, the cost as well as the overall weight of the product can be reduced since less material is used.

In the lamp of the present invention, the concave mirror 22 and converging lens 23 of each high-power LED light source concentrate the light in the same direction, i.e. the emitted light beams have the same emitting direction. The adoption of multiple LEDs can effectively improve the intensity of the light while adopting the above-mentioned technical scheme can improve the directivity of the light significantly.

The concave mirrors 22 of each high-power LED light source are placed closely on the same plane and the light beams emitted by each LED are therefore arranged tightly, making the light emitted by the lamp, as a whole, full and soft. The converging lens 23 of each high-power LED light source can also be integrated into one piece to facilitate installation of the lens.

These LEDs 21 of each high-power LED light source are set on a printed wiring board 26, and a metal-based heat sink is set on the printed wiring board 26. A heat cooling rear cover 25 used for cooling LED 21 is set behind the casing 2, and the metal-based heat sink is compressed tightly to the heating cooling rear cover 25 to dispel or eliminate the heat from of LED 21.

The LED of the high-power LED light source can be a monochromatic single-chip high-power LED or a multi-chip high-power LED or a multi-chip color-changeable high-power LED.

Referring to FIGS. 2 and 3, the diffusing lens 24 which can diffuse the light is set in front of the converging lens 22 of the high-power LED light sources. The surface of the diffusing lens 24 is densely covered with diffusing grain or particles. The diffusing particles or grains are convex lenses. The collimated light beams emitted by each LED are diffused directionally by the diffusing lens 24 to a certain degree to meet the light distribution demand of different functions of lamps. When used together with an atomized soft-light lens or a soft-light lens added with diffusion agent, the lamp can emit light which is even softer and fuller, as a whole.

Figure 4:
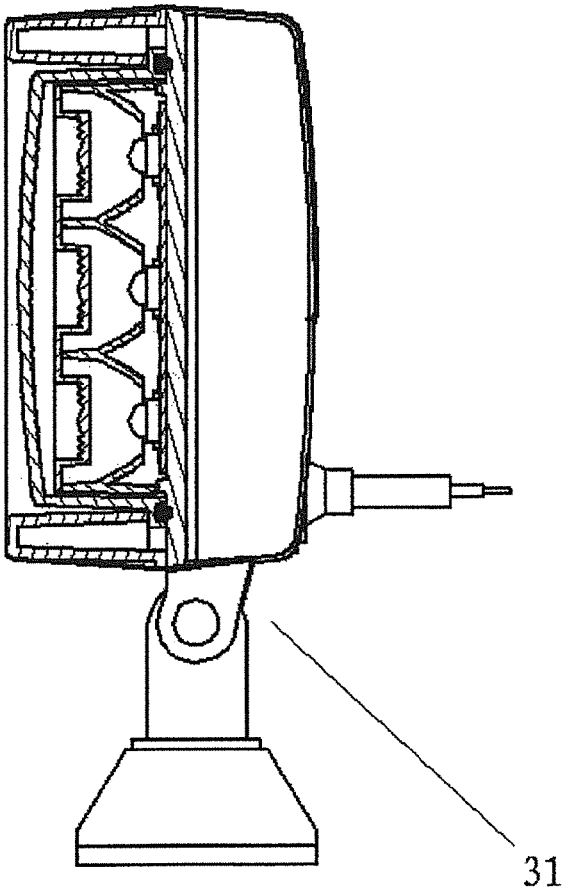
FIG. 4 is a structural drawing of the first embodiment of application of the present invention.
Figure 5:
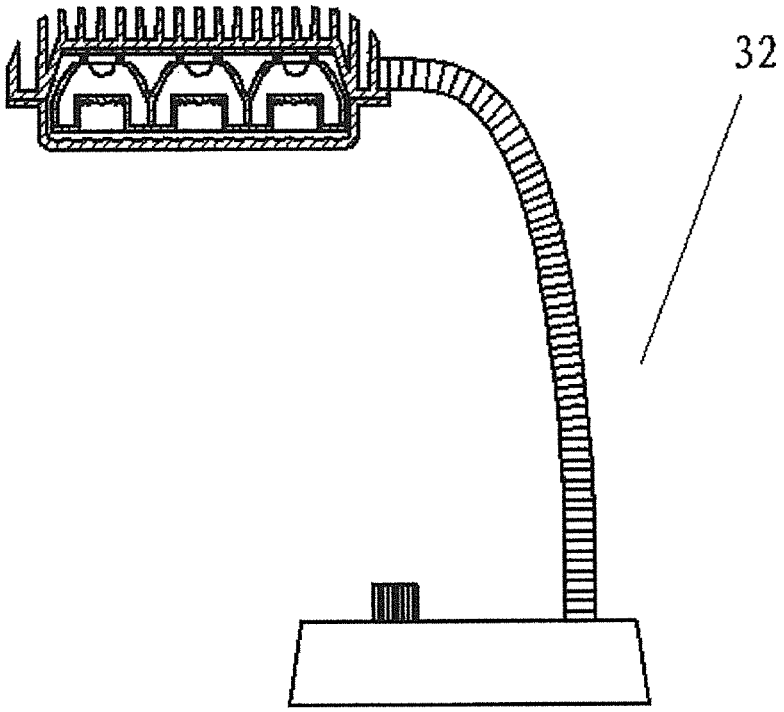
FIG. 5 is a structural drawing of the second embodiment of application of the present invention.

The lamp can be used as work light such as the work light 31 shown in FIG. 4, or, the lamp can be used for automobile lighting such as the automobile interior lamp 32 shown in FIG. 5. Or the lamp can be used for indoor lighting such as the desk lamp 33 shown in FIG. 6. The lamps of the present invention can be used for fabrication of flashlights.

Figure 6:
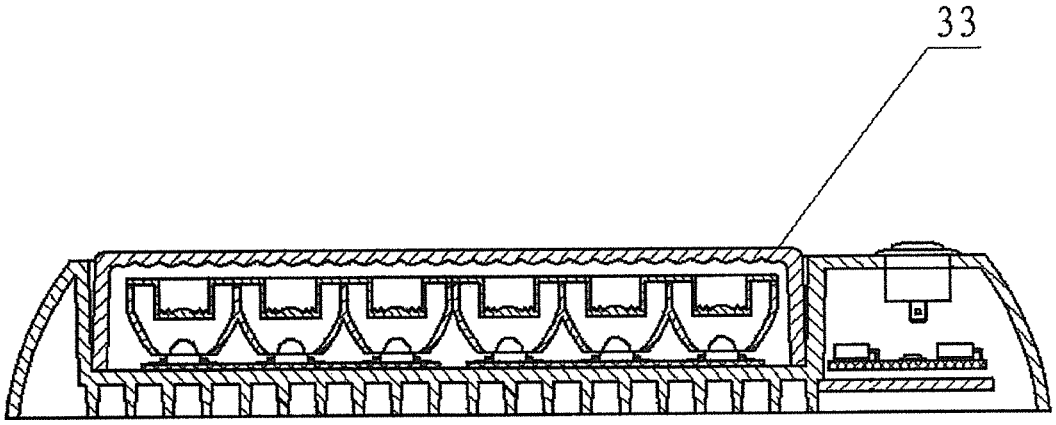
FIG. 6 is a structural drawing of the third embodiment of application of the present invention.
Figure 7:
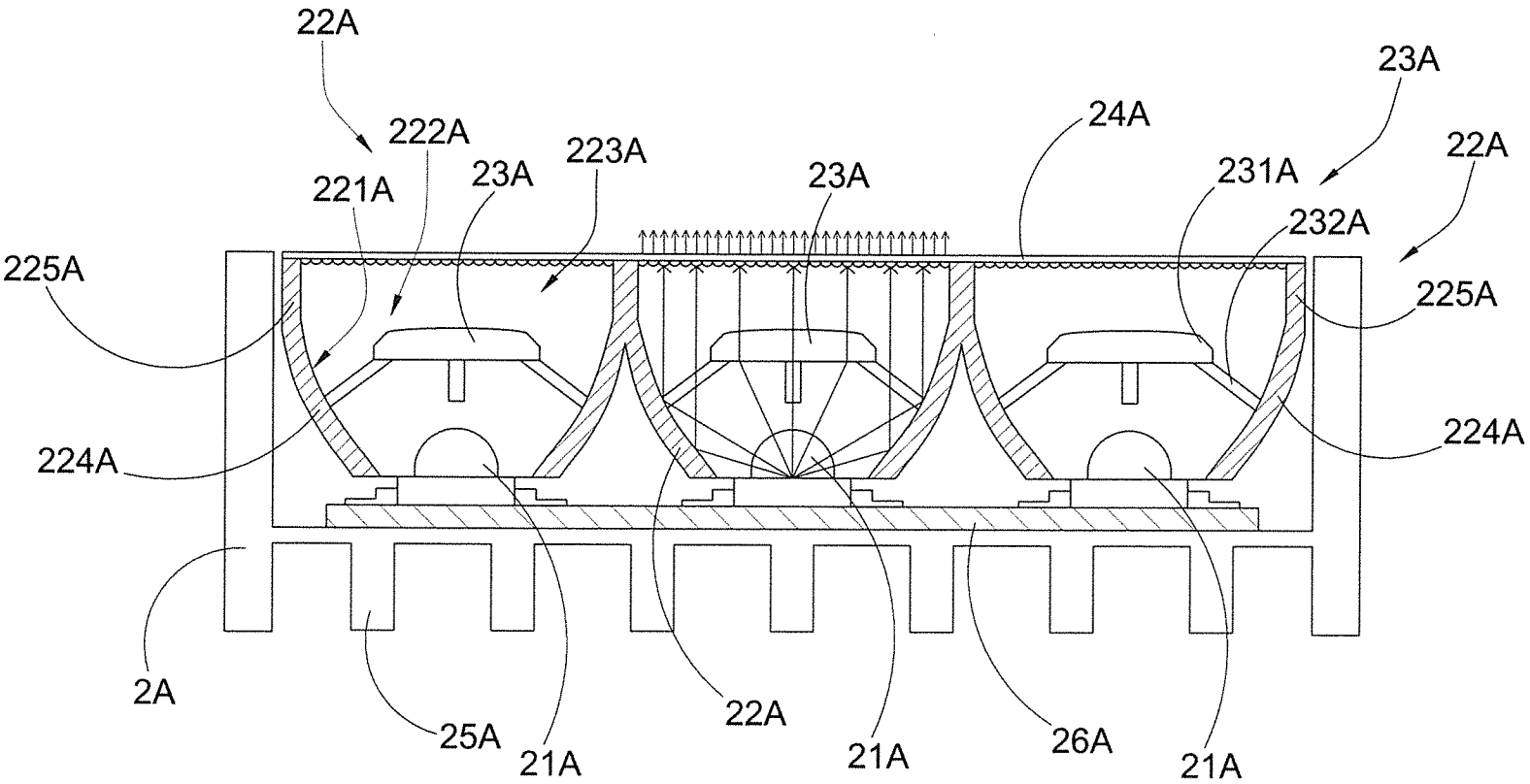
FIG. 7 is a sectional view of a lamp and its high-power LED light source according to a second embodiment of the present invention.

As shown in FIG. 7, a light module according to a second embodiment illustrates an alternative mode of the above embodiment, wherein the light module can be equipped with the lamp such as the work light as shown in FIG. 4, the automobile interior lamp as shown in FIG. 5, or a desk lamp as shown in FIG. 6.

The light module comprises a casing 2A and a plurality of high-power LED light sources disposed in the casing 2A. Each high-power LED light source comprises a LED 21A, a condenser 22A which concentrates the light emitted by the LED 21A, and a converging lens 23A located in front of the LED 21A.

The condensers 22A are integrally coupled with each other side-by-side to form a condenser unit. As shown in FIG. 7, the condensers 22A comprises a plurality of concave mirrors closely located side-by-side, wherein each of the condensers 22A, having a bowl shape, defines a light reflecting wall 221A, a light cavity 222A therewithin, and a light opening 223A. In particular, each of the condensers 22A has a concave portion 224A and a tubular portion 225A integrally extended thereof, wherein the LED 21 is disposed at focal point of the concave portion 224A. Accordingly, a cross sectional area of the concave portion 224A of each of the condensers 22A is gradually increased toward the tubular portion 225A. The tubular portion 225A of each of the condensers 22A has a uniform diameter, wherein the light opening 223A of the condenser 22A is defined at the tubular portion 225A thereof.

Figure 8:
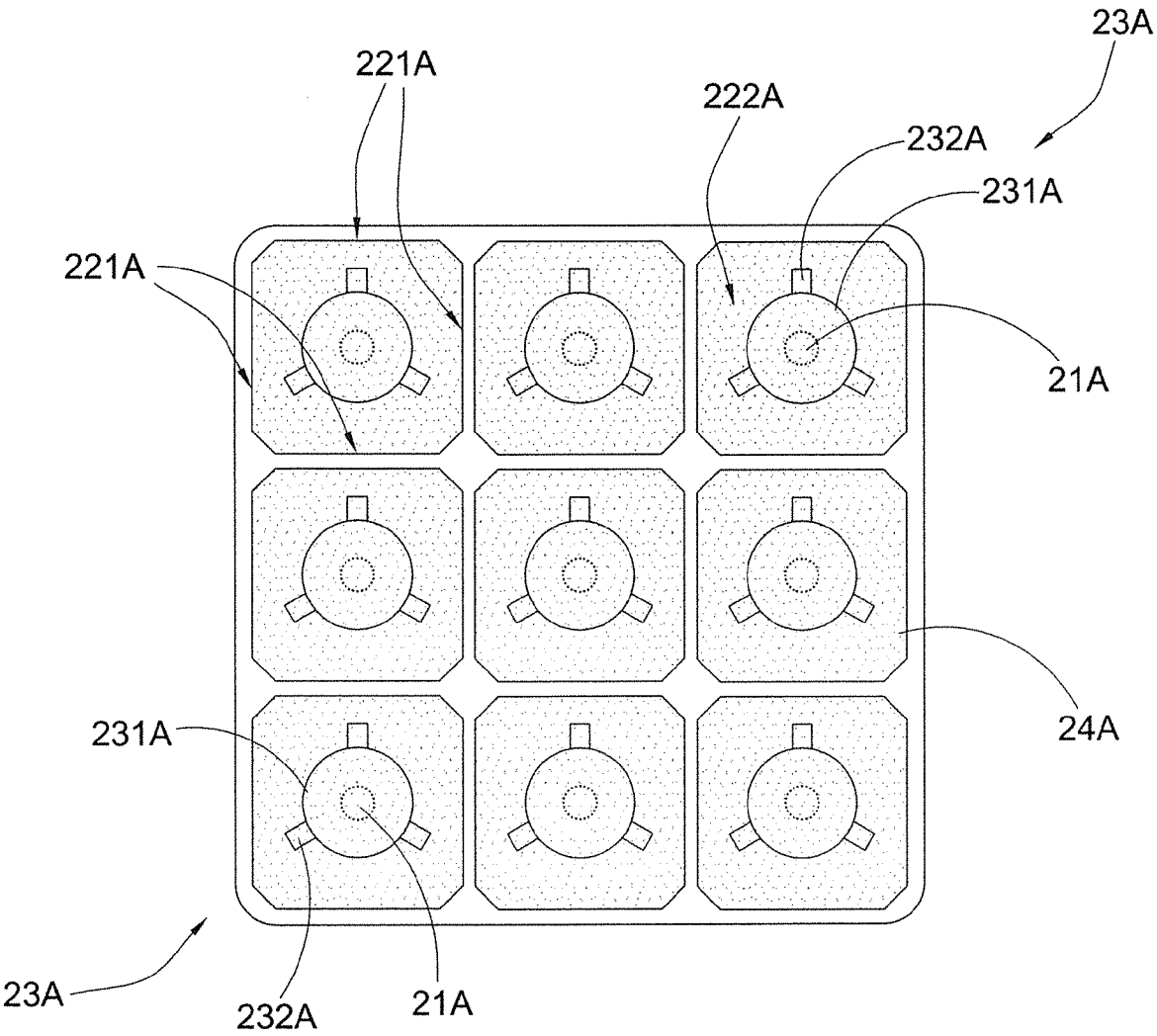
FIG. 8 is a front view of a lamp and its high-power LED light source according to the second embodiment of the present invention.

The light reflecting wall 221A has an interior reflecting surface to reflect the light from the LED 21A. Accordingly, the interior reflecting surface of the light reflecting wall 221A is a concave surface at the concave portion 224A of the condenser 22A. The interior reflecting surface of the light reflecting wall 221A is a flat surface at the tubular portion 224A of the condenser 22A. When the tubular portion 224A of the condenser 22A has a rectangular cross section, as shown in FIG. 8, the interior reflecting surface is formed at each of four facets. When the tubular portion 224A of the condenser 22A has a honeycomb cross section, the interior reflecting surface is formed at each of six facets.

The light reflecting walls 221A of the condensers 22A are integrally coupled with each other side-by-side, as shown in FIG. 7, such that the high-power LED light sources form a plurality of light cells closely located side-by-side. In particular, the tubular portions 225A of the condensers 22A are integrally coupled with each other side-by-side. Each of the condensers 22A is formed in a honeycombed shape or in a rectangular array. In other words, the cross section of the tubular portion 225A of each of the condensers 22A has a honeycombed shape or in a rectangular shape. It is worth mentioning that since the tubular portions 225A of the condensers 22A are integrally coupled with each other side-by-side, the two adjacent condensers 22A share a portion of the tubular portion 225A as shown in FIG. 7.

The LED 21A is disposed in the light cavity 222A at a position that the emitting part of the LED 21 is located at the focal point of the condenser 22A. It is worth mentioning that the light reflecting wall 221A has a concave surface, such that when the LED 21A emits light in a radial direction, a first portion of light will directly project toward the light opening 223A of the condenser 22A while a second portion of the light will be reflected by the light reflecting wall 221A of the condenser 22A to the light opening 223A thereof. In other words, the light emitted from the LED 21A will be concentratedly projected out of the light opening 223A of the condenser 22A.

The converging lens 23A is located in front of the LED 21A within the light cavity 222A, wherein the focus of the converging lens 23A is located at the emitting part of the LED 21A. This design facilitates the emitting of collimated light beams and is suitable for occasions where collimated light beams are needed. The converging lens 23A can be either a convex lens or a Fresnel lens.

As shown in FIG. 7, the converging lens 23A comprises a lens body 231A and a plurality of supporting legs 232A raidally and downwardly extended from the lens body 231A to couple at the light reflecting wall 221A of the condenser 22A so as to suspendedly support the lens body 231A above the LED 21A. Accordingly, three supporting legs 232A are inclinedly extended from the lens body 231A to couple at the light reflecting wall 221A of the condenser 22A as shown in FIG. 8. In particular, the lens body 231A is supported within the light cavity 223A between the concave portion 224A and the tubular portion 225A. The lens body 231A is also located with respect to the center of the tubular portion 225A of the condenser 22A.

As it is mentioned above, the first portion of light will directly project toward the light opening 223A of the condenser 22A. Accordingly, the LED 21 is located at the focal point of the converging lens 23A that the distance between the emitting part of the LED 21A and the converging lens 23A is the focal length of the converging lens 23A. Therefore, the first portion of the light from the LED 21 A will penetrate through the converging lens 23A and will diverge the first portion of the light in parallel light rays which will be projected out of the light opening 223A of the condenser 22A. In other words, the first portion of light, which is not reflected by the light reflecting wall 221A of the condenser 22A, will be diverged into parallel light rays out of the light opening 223A of the condenser 22A.

The second portion of the light will be reflected within the concave portion 224A of the condenser 22A by the light reflecting wall 221A thereof to parallelly project out of the light opening 223A of the condenser 22A. In other words, the first portion of light diverged by the converging lens 23A and the second portion of light reflected by the light reflecting wall 221A of the condenser 22A will form collimated light beams out of the light opening 223A of the condenser 22A. The first portion of light diverged by the converging lens 23A and the second portion of light reflected by the light reflecting wall 221A of the condenser 22A will not be overlapped with each other. Therefore, the tubular portions 225A of the condensers 22A are extended parallel with respect to the collimated light beams to enhance a light intensity thereof. It is worth mentioning that the collimated light beams will project out of the light opening 223A of the condenser 22A parallel to the interior reflecting surface of the light reflecting wall 221A at the tubular portion 225A of the condenser 22A. Furthermore, all the lights from the LEDs 21A will generate the collimated light beams projected out of the condensers 22A for enhancing the illuminating power of the light module.

Accordingly, the interior reflecting surface of the light reflecting wall 221A at the tubular portion 225A will enhance the light intensity of the collimated light beams. In addition, the light from the LED 21A will not directly projected on the interior reflecting surface of the light reflecting wall 221A at the tubular portion 225A. In other words, the tubular portions 225A of the condensers 22A provide multiple functions of enhancing the light intensity of the collimated light beams, ensuring the collimated light beams to be projected out of the light openings 223A at the same direction, and integrally linking the condensers 22A with each other.

The light module further comprises a diffusing lens 24A coupled at the light openings 223A for diffusing the collimated light beams, wherein the diffusing lens 24A can diffuse the light is set in front of the converging lens 22A of the high-power LED light source. The surface of the diffusing lens 24A is densely covered with diffusing grain or particles. The difffising particles or grains are convex lenses. In other words, the convex lenses are integrally formed at the surface of the diffusing lens 24A facing toward the LED 21A. The collimated light beams emitted by each LED 21A are diffused directionally by the diffusing lens 24A to a certain degree to meet the light distribution demand of different functions of lamps. When used together with an atomized soft-light lens or a soft-light lens added with diffusion agent, the lamp can emit light which is even softer and fuller, as a whole.

A circuit board 26A and a metal-based heat sink are set on the circuit board 26A. Accordingly, the circuit board 26A is supported by the casing 2A to house the LEDs 21 therein. A heat cooling rear cover 25A used for cooling LEDs 21A is set behind the casing 2, and the metal-based heat sink is compressed tightly to the heating cooling rear cover 25A to dispel or eliminate the heat from of LEDs 21A. In other words, the LEDs 21A are spacedly and electrically coupled on the circuit board 26A, wherein the condenser unit is coupled on the circuit board 26A at a position that the LEDs 21A are encircled by the condensers 22A respectively.

It is believed that the fundamental principle, key features and the advantages of the present invention are understood from the foregoing description. The technical personnel of the industry should understand that the present invention is not limited to the above embodiments. The embodiments and specifications hereinbefore described only explain the principle of the present invention, and it is apparent that various changes and improvements may be made thereto without departing from the spirit and scope of the invention. Such changes and improvements fall into the scope of the present invention which claims protection. The scope of protection claimed by the present invention is defined by the attached claims and their equivalents.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A light module, comprising:

a circuit board, a plurality of LEDs spacedly and electrically coupled on said circuit board for light generation;

a condenser unit comprising a plurality of condensers integrally coupled with each other and supported on said circuit board, wherein each of said condensers has a light cavity that said LED is supported therewithin, a light opening, and a light reflecting wall for reflecting the light from the LED toward said light opening; and a plurality of converging lenses supported within said light cavities of said condensers respectively, wherein each of said LEDs is located at a focal point of said condenser and is located at a focal point of said converging lens, wherein a first portion of light from said LED is directly project toward said converging lens and is diverged by said converging lens to parallelly project out of said light opening of said condenser, wherein a second portion of light from said LED is reflected by said light reflecting wall of said condenser to parallelly project out of said light opening of said condenser, such that said first portion of light diverged by said converging lens and said second portion of light reflected by said light reflecting wall of said condenser form collimated light beams out of said light opening of said condenser, wherein each of said condensers further has a concave portion and a tubular portion, wherein said concave portion has an interior concave reflective surface that said LED is disposed at said concave portion of said condenser, wherein said tubular portion has an interior flat reflective surface that said light opening of said condenser is defined at said tubular portion of said condenser, wherein said tubular portions of said condensers are integrally coupled side-by-side.

2. The light module, as recited in claim 1, wherein said tubular portions of said condensers are extended parallel with respect to said collimated light beams to enhance a light intensity thereof.

3. The light module, as recited in claim 2, wherein each of said converging lenses comprises a lens body and a plurality of supporting legs raidally and downwardly extended from said lens body to couple at said light reflecting wall of said condenser so as to suspendedly support said lens body above said LED.

4. The light module, as recited in claim 3, wherein said lens body is supported within said light cavity between said concave portion of said condenser and said tubular portion thereof.

5. The light module, as recited in claim 4, further comprising a diffusing lens coupled at said light openings of said condensers for diffusing said collimated light beams.

6. The light module, as recited in claim 5, wherein said diffusing lens has a plurality of convex lenses integrally formed at a surface of said diffusing lens that faces toward said LED for directionally diffusing said collimated light beams emitted by said LED.

7. The light module, as recited in claim 6, further comprising a heat sink mounted at said circuit board for dissipating heat from said LEDs.

8. The light module, as recited in claim 7, further comprising a casing, wherein said circuit board is supported by casing to house said LEDs therein.

9. The light module, as recited in claim 1, wherein each of said converging lenses comprises a lens body and a plurality of supporting legs raidally and downwardly extended from said lens body to couple at said light reflecting wall of said condenser so as to suspendedly support said lens body above said LED.

10. The light module, as recited in claim 9, wherein said lens body is supported within said light cavity between said concave portion of said condenser and said tubular portion thereof.

11. The light module, as recited in claim 1, further comprising a diffusing lens coupled at said light openings of said condensers for diffusing said collimated light beams.

12. The light module, as recited in claim 11, wherein said diffusing lens has a plurality of convex lenses integrally formed at a surface of said diffusing lens that faces toward said LED for directionally diffusing said collimated light beams emitted by said LED.

13. A light module, comprising:

a circuit board, a plurality of LEDs spacedly and electrically coupled on said circuit board for light generation:

a condenser unit comprising a plurality of condensers integrally coupled with each other and supported on said circuit board, wherein each of said condensers has a light cavity that said LED is supported therewithin, a light opening, and a light reflecting wall for reflecting the light from the LED toward said light opening; and a plurality of converging lenses supported within said light cavities of said condensers respectively, wherein each of said LEDs is located at a focal point of said condenser and is located at a focal point of said converging lens, wherein a first portion of light from said LED is directly project toward said converging lens and is diverged by said converging lens to parallelly project out of said light opening of said condenser, wherein a second portion of light from said LED is reflected by said light reflecting wall of said condenser to parallelly project out of said light opening of said condenser, such that said first portion of light diverged by said converging lens and said second portion of light reflected by said light reflecting wall of said condenser form collimated light beams out of said light opening of said condenser, wherein each of said converging lenses comprises a lens body and a plurality of supporting legs raidally and downwardly extended from said lens body to couple at said light reflecting wall of said condenser so as to suspendedly support said lens body above said LED.

* * * * *